United States Patent [19]

Lebedev et al.

[11] 4,105,964

[45] Aug. 8, 1978

[54] VOLTAGE REGULATION AND STABILIZATION DEVICE

[76] Inventors: Vladimir Konstantinovich Lebedev, ulitsa Engelsa, 25, kv. 12; Jury Dmitrievich Gupalo, ulitsa Anri Barbjusa, 22-26, kv. 25; Vladimir Alexandrovich Troitsky, ulitsa Bratislavskaya, 8, kv. 86; Nikolai Grigorievich Bely, ulitsa Stepana Razina, 3, kv. 10; Vladimir Alexandrovich Nagaitsev, ulitsa Stroitelei, 26, kv. 6; Boris Vladimirovich Nudelman, ulitsa Filatova, 1/22, kv. 87, all of Kiev; Alexandr Ivanovich Krasnov, Molodezhny bulvar, 4, kv. 7, Tolyatti Kuibyshevskoi oblasti; Jury Iosifovich Borju, Stavropolskaya ulitsa, 23, kv. 6, Tolyatti Kuibyshevskoi oblasti; Dmitry Nikolaevich Parshin, Kommunistisheskaya ulitsa, 55, kv. 80, Tolyatti Kuibyshevskoi oblasti; Pavel Andreevich Zhinzhikov, ulitsa Kostycheva, 41, kv. 195, Bryansk; Alexandr Nikolaevich Korneev, Promyshlennaya ulitsa, 69, kv. 23, TolyattiKuibyshevskoi oblasti, all of U.S.S.R.

[21] Appl. No.: 746,007

[22] Filed: Nov. 30, 1976

[51] Int. Cl.[2] ..... G05F 1/20

[52] U.S. Cl. ..... 323/43.5 S; 323/45; 323/57

[58] Field of Search ..... 323/43.5 S, 43.5 R, 323/45, 57, 62, 91

[56] References Cited

U.S. PATENT DOCUMENTS

| | | | |
|---|---|---|---|
| 3,319,153 | 5/1967 | Livingston | 323/43.5 S |
| 3,721,894 | 3/1973 | Beckwith | 323/43.5 S |
| 3,858,104 | 12/1974 | Grob | 323/43.5 S |
| 3,970,918 | 7/1976 | Cooper | 323/43.5 S |

*Primary Examiner*—Gerald Goldberg

*Attorney, Agent, or Firm*—Lackenbach, Lilling & Siegel

[57] ABSTRACT

According to the invention, the voltage regulation and stabilization device comprises a transformer with magnetized yokes; a switch of power winding taps of the transformer; and a control circuit incorporating a comparison unit, an intermediate amplifier, a differential power amplifier, voltage regulation margin measuring units, an electronic commutator, and a power supply for the control circuit units. The device of this invention makes it possible to expand the range of continuous voltage regulation, while maintaining a high power factor and reducing the consumption of active materials.

33 Claims, 15 Drawing Figures

VOLTAGE REGULATION AND STABILIZATION DEVICE

The present invention relates to static adjustment apparatus and, more particularly, to voltage regulation and stabilization devices.

The invention is applicable to a.c. and d.c. devices which require high amplitude voltage regulation and stabilization of voltage to make it independent of supply voltage and load fluctuations.

One of the important current problems in the field of electrical engineering is the development of and improvements in contactless voltage regulators and stabilizers which are part and parcel of most of today's electronic and electrical devices which impose stringent requirements upon supply voltage characteristics, operating speed and reliability.

There is known a voltage regulation and stabilization device comprising a transformer with power windings mounted on the magnetic circuit legs, some of the power windings being arranged in the window formed by the yokes. On each yoke there are mounted control windings which are magnetized by direct current. The device under review further comprises switches of power winding taps of the transformer and a control circuit incorporating a number of serially connected units which include a comparison unit, an intermediate amplifier and a differential power amplifier connected to the control windings of the transformer's yokes, as well as power supply units for the control circuit units.

In the course of voltage regulation, there takes place a redistribution of magnetizing ampere-turns between the upper and middle yokes of the transformer.

Output voltage of the device for voltage regulation and stabilization under review is applied via a bridge rectifier of the comparison unit to the measuring unit which is a parametric bridge build of a silicon avalanche diode. The signal from the measuring unit is amplified by the semiconductor intermediate relay amplifier, which is constructed as a contactless relay, and applied to the differential power amplifier which either connects or disconnects the control windings of the transofrmer's yokes. If the output voltage is in excess of a prescribed magnitude, the current in the control winding of the transformer's upper yoke increases, and the current in the control winding of the middle yoke decreases. As this takes place, the magnetic resistance of the upper yoke increases, while that of the middle yoke decreases. The flux linkage of the part of the power winding turns located in the window formed by the controlled yokes decreases, which reduces the electromotive force induced in these turns. The output voltage of the device for voltage regulation and stabilization is reduced. When the output voltage is below the prescribed magnitude, the polarity of the signal picked up from the measuring bridge is reversed. Consequently, the polarity of the signal picked up from the output of the intermediate amplifier and applied to the inputs of the differential power amplifier is reversed. The current in the control winding of the upper yoke decreases, and the current in the control winding of the middle yoke increases. The magnetic conductance of the upper yoke increases, while that of the middle yoke decreases. The flux linkage of the part of the turns that are located in the window formed by the controlled yoke starts to increase, which causes an increase in the electromotive force induced in said turns. As a result, the output voltage rises until it is in excess of the prescribed value. When this takes place, the polarity of the signal picked up from the measuring unit is again, whereby the control winding of the upper yoke is connected and that of the middle yoke is disconnected, etc.

Thus, by alternately connecting the control windings of the transformer's yokes, the direct current in said windings and, consequently, the resistance to the alternating flux of the controlled yokes are changed so as to maintain the prescribed voltage across the output of the device for voltage regulation and stabilization.

By varying the resistance of a resistor placed in series with the measuring unit it is possible to continuously adjust the output voltage of the voltage regulation and stabilization device.

However, the known voltage regulation and stabilization device does not provide for high continuous voltage regulation, while maintaining a high power factor and bringing to a minimum the consumption of active materials.

The use in the known voltage regulation and stabilization device of a three-phase symmetrical transformer, whose yokes are constructed as a closed polygon, raises the coefficient of harmonic distortion of the output voltage which amounts to 5% in idle states and increases to 25 to 30% under load. This is due to the fact that direct current magnetization of the controlled yokes constructed in the form of a closed polygon create even harmonics. The even harmonics are amplified as the load is connected to the output of the transformer, i.e. when there is an increase in the double magnetization of the transformer's controlled yokes (by the constant and alternating magnetic fields).

The use of a three-phase symmetrical transformer, whose controlled yokes are star-shaped, the control windings being arranged along the axis of symmetry, limits the voltage regulation range; besides, such a transformer does not provide for phase-by-phase voltage regulation.

It is an object of the present invention to provide a voltage regulation and stabilization device which, while maintaining a high power factor and minimizing the consumption of active materials, would ensure high continuous voltage regulation without disruptions in the working current, as well as without overvoltages, when switching over from one regulation range to another.

The foregoing object is attained by providing a voltage regulation and stabilization device comprising a transformer with power windings on the legs of its magnetic circuit, a part of the power winding turns being arranged in the window formed by yokes, whereon there are arranged control windings which are to be magnetized by direct current; a switch of taps of the transformer's power windings; and at least one control circuit composed of serially connected units which include a comparison unit, an intermediate amplifier and a differential power amplifier connected to the control windings of the transformer's yokes, as well as a power source for the control circuit's units. The device also includes, in accordance with the invention, units for measuring the voltage regulation margin, their inputs being connected to outputs of the differential power amplifier and their outputs being connected an electronic commutator. The commutator comprises flip-flops, logical NAND circuits and logical NOR OR circuits, inverters, and delay units, outputs of the electronic commutator being connected to the switch of the taps of the transformer's power windings.

It is expedient that the device should include a trigger connected to the electron commutator and comprising a transistor and a capacitor in its charge and discharge circuits.

It is desirable that the device should include an inverter whose input is connected via a capacitor to one of the inputs of the electronic switch, and whose output is connected via a diode to the input of the intermediate amplifier.

It is preferable that the transformer should be a three-phase symmetrical transformer, the legs of the magnetic circuit of said transformer be arranged at an angle of 120° in relation to one another, the lower, middle and upper yokes being arranged between said legs, the lower yoke be uncontrolled, and the upper and middle yokes be controlled.

It is desirable that the controlled yokes should be star-shaped.

It is preferable that the control winding of the upper yoke should be arranged along the symmetry axis of the three-phase symmetrical transfomer, and that the control winding of the middle yoke should be composed of individual coils mounted on half-yokes and interconnected in series opposition.

It is also desirable that the three-phase symmetrical transformer should have a central leg, the control windings of the middle and upper yokes being composed of three pairs of coils arranged on half-yokes, the coils of the control windings of each phase being interconnected in series opposition and connected to individual control circuits.

It is highly desirable that the controlled yokes of the three-phase symmetrical transformer should be constructed as a closed polygon and split into two portions, each of said portions carrying control winding coils interconnected in series opposition.

It is highly desirable to provide the transformer with supply windings of the control circuit units, which windings are directly mounted on the legs of the transformer's magnetic circuit.

It is advisable that a portion of the turns of the supply windings of the control circuit should be arranged in the window formed by the controlled yokes.

Finally, it is advisable that the transformer's circuitry should be that of an autotransformer.

Other objects and advantages of the present invention will become more apparent from the following detailed description of preferred embodiments thereof to be read in conjunction with the accompanying drawings, wherein.

Figure 14:
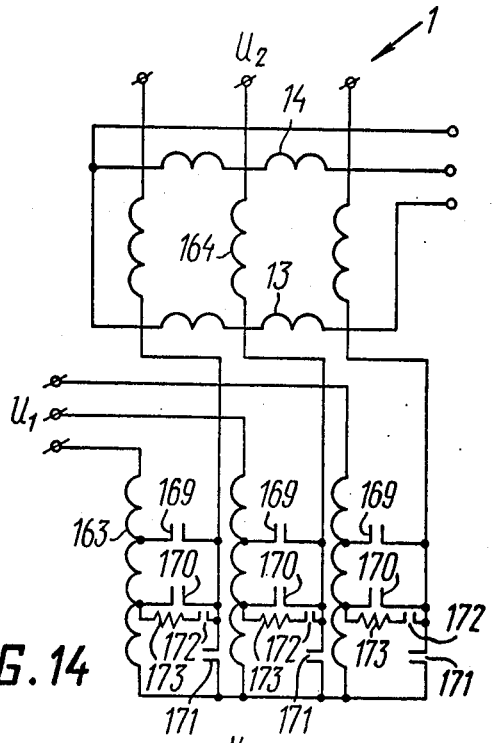
Figure 15:
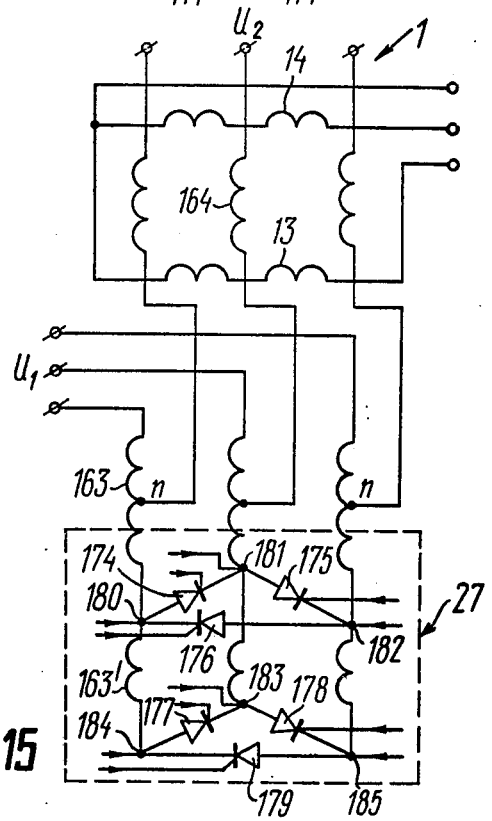

FIG. 14 is an electrical schematic diagram of a transformer having autotransformer circuitry with magnetic commutation, the controlled turns of said transformer being connected to the taps of the uncontrolled turns, in accordance with the invention; and FIG. 15 is an electrical schematic diagram of a transformer with the autotransformer circuitry with magnetic commutation, said transformer having switchable taps of the windings which are star-connected, in accordance with the invention.

Referring now to the attached drawings, the proposed voltage regulation and stabilization device comprises a transformer 1 (FIG. 1) whose output 2 is connected to an input 3 of a comparison unit 4. An output 5 of the comparison unit 4 is connected to an input 6 of an intermediate amplifier 7, which has a reversible output 8 connected to an input 9 of a differential power amplifier 10. Outputs 12 and 11 of the differential power amplifier 10 are connected to yoke control windings 13 and 14, respectively, of the transformer 1. The proposed voltage regulation and stabilization device further includes an electronic commutator 15. A first input 16 of the electronic commutator 15 is connected to an output 17 of a first unit 18 for measuring the voltage regulation margin, its input 19 being connected to the output 11 of the differential power amplifier 10. A second input 20 of the electonic commutator 15 is connected to an output 21 of a second unit 22 for measuring the voltage regulation margin, its input 23 being connected to the output 12 of the differential power amplifier 10. Outputs 24, 25 annd 26 of the electronic commutator 15 are connected to a switch 27 of power winding taps, the switch 27 being connected to the taps of the power windings of the transformer 1. The device still further comprises a trigger 28, an inverter 29, and a power source 30 for the control circuit units of the transformer 1.

Figure 2:
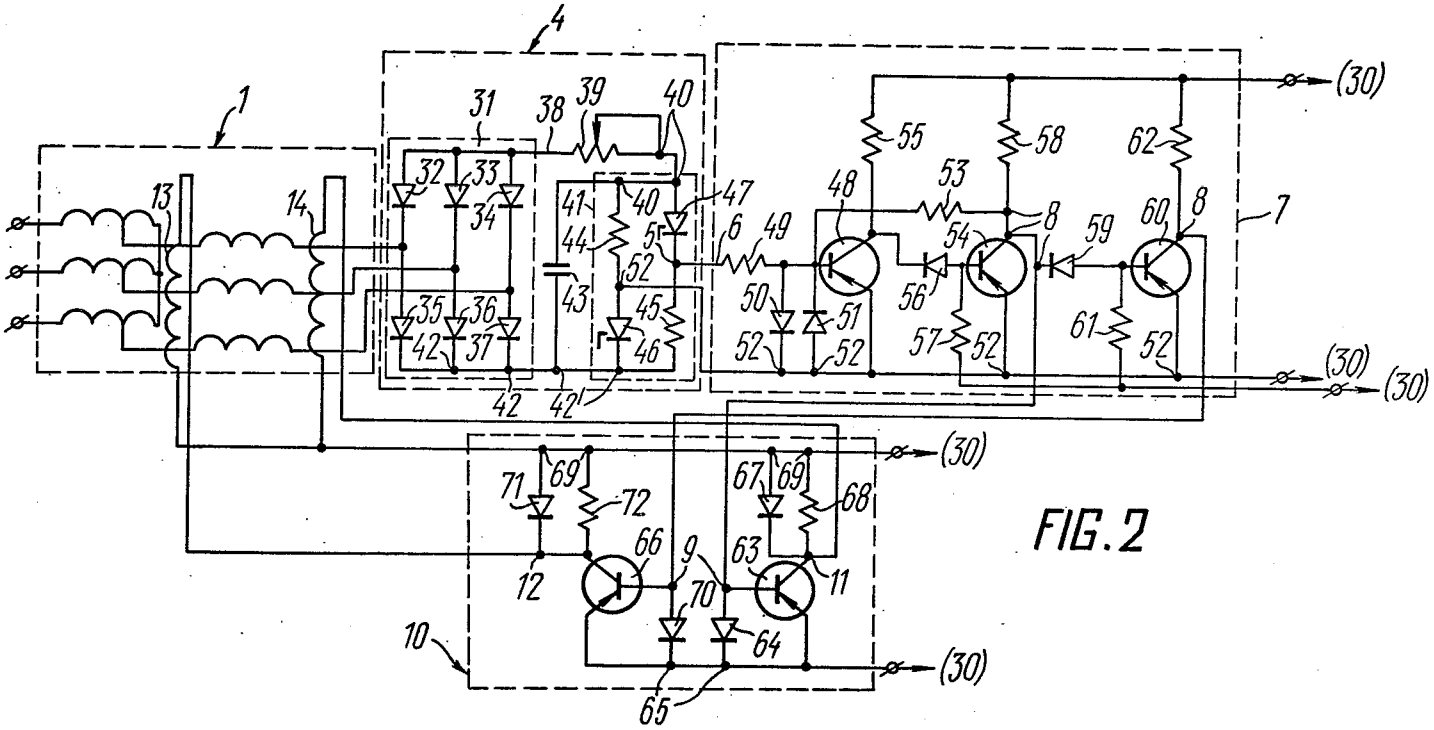
FIG. 2 is an electrical schematic diagram of a voltage regulation and stabilization device with a magnetic commutation-controlled transformer and with differentially controlled yokes, in accordance with the invention.

The comparison unit 4 comprises a bridge rectifier 31 (FIG. 2) built of diodes 32, 33, 34, 35, 36 and 37. Said bridge rectifier 31 is connected with its first output 38 via a resistor 39 to a first input 40 of a parametric bridge 41. A second output 42 of the bridge rectifier 31 is connected to a second input 42' of the parametric bridge 41.

Between the inputs 40 and 42' of the parametric bridge 41 there is placed a capacitor 43. The parametric bridge 41 includes two resistors 44 and 45 and two avalanche diodes 46 and 47. The output of the parametric bridge 41 is the output 5 of the comparison unit 4 and is connected to the input 6 of the intermediate amplifier 7.

The intermediate amplifier 7 comprises a transistor 48 whose base is connected via a resistor 49 to the output 5 of the comparison unit 4 (the input 6 of the amplifier 7). The base of the transistor 48 is coupled via diodes 50 and 51, which are placed in parallel opposition, and a junction point 52 to the power source 30 and, via a feedback resistor 53, to the collector of a transistor 54. The collector of the transistor 48 is connected via a resistor 55 to the power source 30 and via a diode 56 to the base of the transistor 54. The emitter of the transistor 48 is connected to the power source 30. The base of the transistor 54 is connected via a resistor 57 to the power source 30. The emitter of the transistor 54 is connected to the power source 30. The collector of the transistor 54 is connected via a resistor 58 to the power source 30 and via a diode 59 to the base of a transistor 60. The base of the transistor 60 is connected via a resistor 61 to the power source 30. The emitter of the transistor 60 is coupled via the junction point 52 to the power source 30. The collector of the transistor 60 is connected via a resistor 62 to the power source 30.

The differential power amplifier 10 comprises a transistor 63 whose base is connected via a diode 64 and a junction point 65 to the emitter of the transistor 63, the emitter of a transistor 66 and the power source 30. The collector of the transistor 63 is coupled via a diode 67, a resistor 68, and the yoke control winding 14 of the transformer 1, which are placed in parallel, and a junction point 69 to the power source 30. The base of the transistor 66 is connected via a diode 70 and the junction point 65 to the emitter of the transistor 66. The collector of the transistor 66 is coupled via a diode 71, a resistor 72, and the yoke control winding 13 of the transformer 1, which are placed in parallel, and the junction point 69 to the power source 30.

Figure 1:
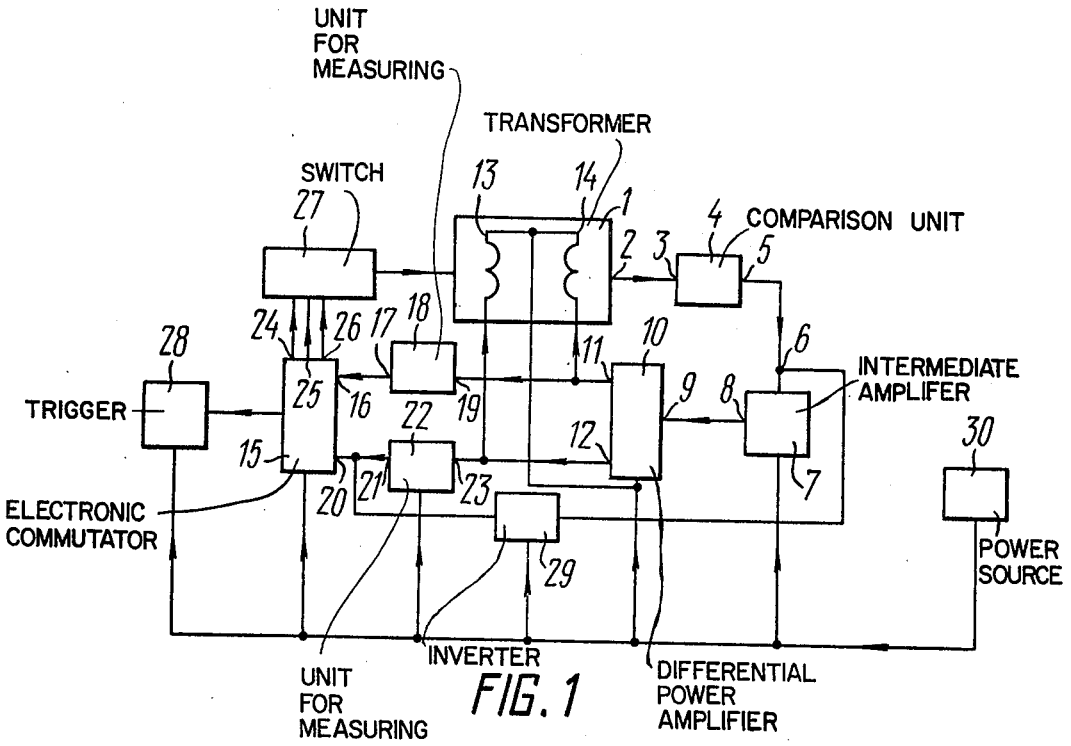
FIG. 1 is a block diagram of a voltage regulation and stabilization device in accordance with the invention.

The unit 18 (FIG. 3) for measuring the voltage regulation margin includes a transistor 73 whose base is connected via a resistor 74 to the output 11 of the differential power amplifier 10 (the input 19 of the unit 18 for measuring). The collector of the transistor 73 is connected via a resistor 75 to the power source 30, and via a resistor 76 to a junction point 77. Also connected to the junction point 77 is a lead of a capacitor 78 and a lead of an avalanche diode 79. A second lead of the capacitor 78 and the emitters of transistors 73 and 81 are connected to a junction point 80. The base of the transistor 81 is connected to a second lead 82 of the avalanche diode 79. The collector of the transistor 81 is connected via a resistor 83 to the power source 30 (FIG. 1).

The unit 22 for measuring the voltage regulation margin is similar to the unit 18 for measuring the voltage regulation margin. The output 21 of the unit 22 is connected to the second input 20 of the electronic commutator 15.

The electronic commutator 15 comprises a flip-flop 84 whose input 85 is connected via a junction point 86 to the first input 16 of the electronic commutator 15 and to an input 87 of a logical NOR circuit 88. A second input 89 of the flip-flop 84 is connected via a junction point 90 to an output 91 of an inverter 92 whose input 93 is connected to an output 94 of a logical NOR circuit 95. An output 96 of the flip-flop 84 is connected to an input 97 of a logical NAND circuit 98. A second output 99 of the flip-flop 84 is connected via a junction point 10 to an input 101 of a logical NAND circuit and an input 103 of a logical NAND circuit 104.

The electronic commutator 15 also includes a second flip-flop 105. An input 106 of the second flip-flop 105 is connected via a junction point 107 to the second input 20 of the electronic commutator 15 and an input 108 of the logical NOR circuit 95. A second input 108' of the second flip-flop 105 is connected via a junction point 109 to an output 110 of an inverter 111 whose input 112 is connected to an output 113 of the logical NOT OR circuit 88. An output 114 of the second flip-flop 105 is connected to an input 115 of the logical NAND circuit 104. A second output 116 of the second flip-flop 105 is connected via a junction point 117 to an input 118 of the logical NAND circuit 102 and an input 119 of the logical NAND circuit 98.

An output 120 of the logical NOT AND circuit 98 is connected via a junction point 121 to an input 122 of a delay unit 123. An output 124 of the delay unit 123 is connected via an inverter 125 to a second input 126 of the logical NOR circuit 88. An output 127 of the logical NAND circuit 104 is connected via a junction point 128 to an input 129 of a delay unit 130. An output 131 of the delay unit 130 is connected via an inverter 132 to a second input 133 of the logical NOR circuit 95. The output 120 of the logical NAND circuit 98 is connected via the junction point 121 to the output 24 of the electronic commutator 15 and an input of the switch 27 of the power winding taps. The output 127 of the logical NAND circuit 104 is connected via the junction point 128 to the output 26 of the electronic commutator 15 and a third input of the switch 27 of the power winding taps. The logical NAND circuit 102 is connected via the output 25 of the electronic commutator 15 to a second input of the switch 27 of the power winding taps.

The trigger 28 comprises a transistor 134 whose base is connected via a resistor 135, a junction point 136 and a diode 137 to the emitter of the transistor 134 and the power source 30. A capacitor 138 is connected via a junction point 139 to a lead of a resistor 140. A second lead of the resistor 140 is connected to the diode 137 and the emitter of the transistor 134. The capacitor 138 is connected with its second lead via the junction point 136 to the diode 137 and the resistor 135. The collector of the transistor 134 is connected via a junction point 141, a resistor 142 and the junction point 139 to the power source 30. A diode 143 is connected with its first lead via the junction point 141 to the collector of the transistor 134, and with its second lead to the second input 89 of the flip-flop 84. The diode 144 is connected with its first lead to the collector of the transistor 134, and with its second lead to the input 106 of the second flip-flop 105.

The inverter 29 comprises a transistor 145 whose emitter is connected to the power source 30. The base of the transistor 145 is connected to a junction point 146, whereto there are connected one lead of a capacitor 147 and one lead of a resistor 148. A second lead of the capacitor 147 is connected to a junction point 149, whereto there are connected one lead of a resistor 150, one lead of a diode 151 and one lead of a diode 152. A second lead of the resistor 150 is connected via a junction point 153 to the power source 30. A second lead of the resistor 148 is also connected to the junction point 153. The collector of the transistor 145 is connected via a resistor 154 and the junction point 153 to the power source 30 and via a diode 155 to the input 6 of the intermediate amplifier 7. A second lead of the diode 151 is connected via the junction point 109 to the output 110 of the inverter 111. A second lead of the diode 152 is connected to the output 17 of the unit 18 for measuring the voltage regulation margin.

The delay unit 123 comprises a resistor 156 one of whose leads is connected to the input 122 of the delay unit 123. A second lead of the resistor 156 is connected via a capacitor 157 to the power source 30 and via an avalanche diode 158 to the inverter 125 of the electronic commutator 15. The circuitry of the delay unit 130 is similar to that of the delay unit 123.

Figure 4:
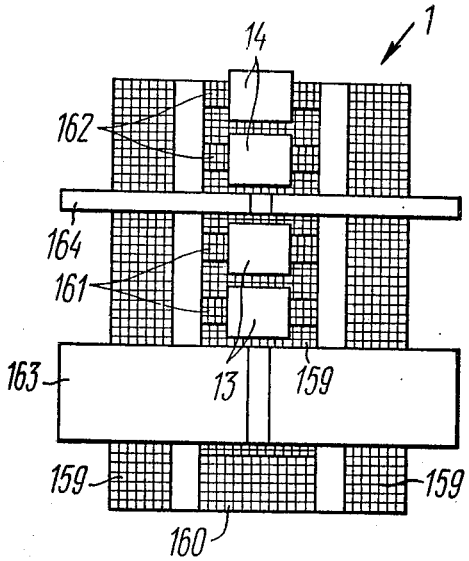
FIG. 4 is an elevational view of a three-phase symmetrical, magnetic commutation-controlled transformer whose yokes form a closed polygon, in accordance with the invention.
Figure 5:
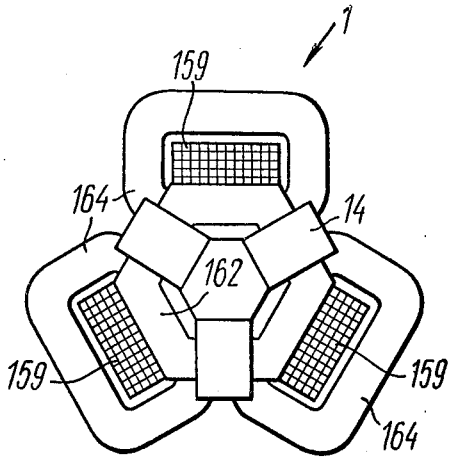
FIG. 5 is a plan view of the transformer of FIG. 4.

The transformer 1 (FIGS. 4 and 5) has three magnetic circuit legs 159 symmetrically arranged at an angle of 120° to each other. Between the magnetic circuit legs 159, there are arranged a lower yoke 160, a middle yoke 161 and an upper yoke 162 which make up a closed polygon. The lower yoke 160 is uncontrolled, but the middle yoke 161 and the upper yoke 162 are controlled. In the lower window, formed by the lower yoke 160, the middle yoke 161 and some of the magnetic circuit legs 159, there is arranged a portion 163 of the turns of the secondary winding and the primary winding (not shown in FIG. 4). A second partion 164 of the secondary winding turns is arranged in the upper window formed by the middle yoke 161 and the upper yoke 162. The turns of the portions 163 and 164 are connected in series. The middle yoke 161 and the upper yoke 162 form separate closed magnetic circuits. The magnetic circuits of the controlled middle yoke 161 and upper yoke 162 are split into two portions. The yoke control windings 13 and 14 are mounted on the respective controlled yokes, the middle yoke 161 and the upper yoke 162. Each of the control windings 13 and 14 is composed of six coils, there being three coils on each split portion of the yokes 161 and 162.

The coils of the yoke control windings 13 and 14 (FIG. 6) are interconnected in series opposition, so that the magnetic fields produced by direct current in the plit portions are oriented in opposition. A plurality winding 165 of the transformer 1 is located, as stated above, in the lower window formed by the lower yoke 160 (FIG. 4), the middle yoke 161 and some of the magnetic circuit legs 159. Mounted directly on the magnetic circuit legs 159 of the transformer 1 are supply windings of the control circuit units, one portion 166 (FIG. 6) of the supply winding turns being arranged in the lower window formed by the lower yoke 160 (FIGS. 4 and 5), the middle yoke 161 and some of the magnetic circuit legs 159. Another portion 167 (FIG. 6) of the supply winding turns is arranged in the upper window formed by the middle yoke 161 and the upper yoke 162.

The middle yoke 161 and the upper yoke 162 arranged between the magnetic circuit legs 159 of the transformer 1 (FIGS. 7 and 8) may also be connected in a star. The secondary winding is divided into two portions. One portion 163 of the secondary winding turns is in the lower window formed by the lower yoke 160 and the middle yoke 161, and another portion 164 of the secondary winding turns is arranged in the upper window formed by the middle yoke 161 and the upper yoke 162 of the transformer 1.

Figure 9:
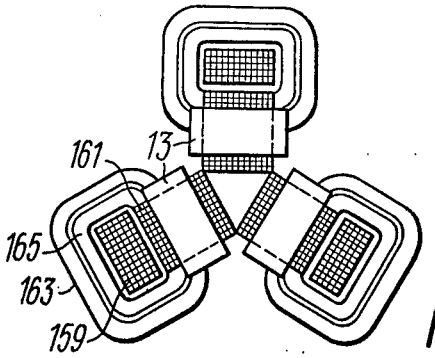
FIG. 9 is a cross sectional view taken along the line IX—IX of FIG. 7.

The entire primary winding 165 (FIG. 9) is in the lower window formed by the lower yoke 160 (FIG. 7) and the middle yoke 161.

Figure 7:
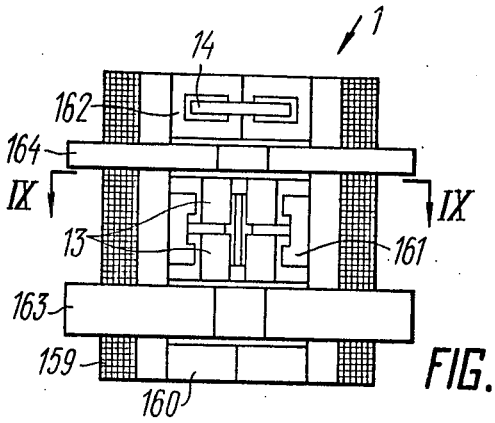
FIG. 7 is an elevational view of a three-phase symmetrical, magnetic commutation-controlled transformer whose yokes make up a star connection, in accordance with the invention.
Figure 8:
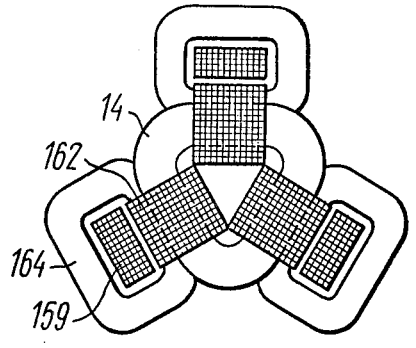
FIG. 8 is a plan view of the transformer of FIG. 7.

The control winding 13 (FIG. 10) of the middle yoke 161 is composed of six individual coils mounted on the half-yokes and interconnected in series opposition. The control winding 14 of the upper yoke 162 is in the windows of the magnetic circuit along the axis of symmetry of the transformer 1 (FIG. 7).

Figure 11:
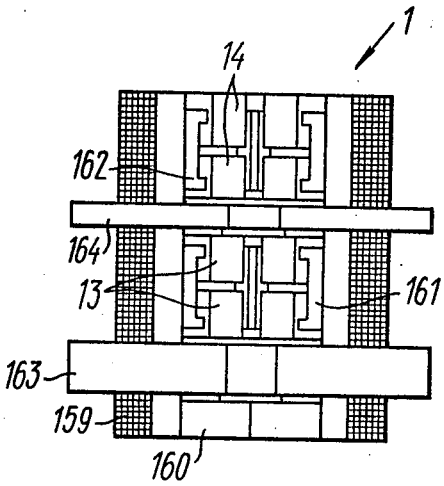
FIG. 11 is an elevational view of a three-phase symmetrical transformer whose yokes are connected into a star with a central leg, said transformer being intended for phase-by-phase voltage regulation, in accordance with the invention.
Figure 12:
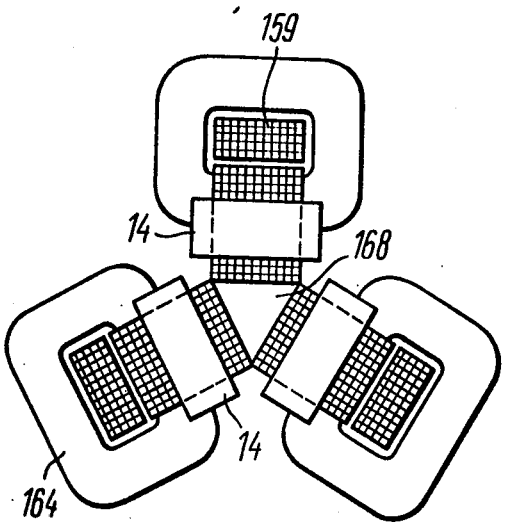
FIG. 12 is a plan view of the transformer of FIG. 11.
Figure 13:
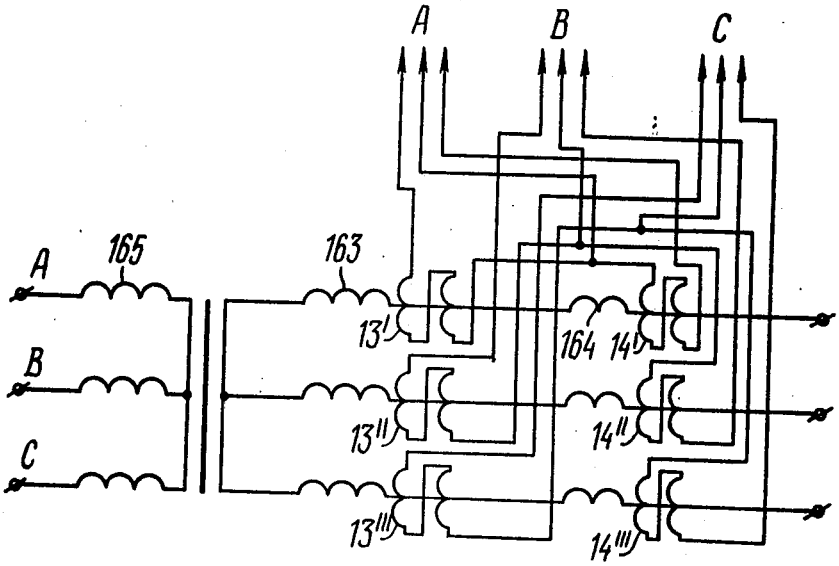
FIG. 13 is an electrical schematic diagram of a three-phase symmetrical transformer with magnetic commutation and phase-by-phase voltage regulation, in accordance with the invention.

The transformer 1 8FIG. 11) has the three magnetic circuit legs 159 symmetrically arranged at an angle of 120° to each other. Arranged between said legs 159 are the three yokes 160, 161 and 162, which are connected in a star, and a central leg 168 (FIG. 12). The transformer 1 of FIG. 11 differs from the foregoing embodiments of said transformer 1 in that the control winding 14 of the upper yoke 162 and the control winding 13 of the middle yoke 161 are composed of three pairs of coils 14', 14'' and 14''' and 13', 13'' and 13''', respectively (FIG. 13), which are mounted on the half-yokes. The pairs of coils 13' and 14', 13'' and 14'', and 13''' and 14''' of each phase, A, B and C, of the middle yoke 161 and the upper yoke 162, respectively, are connected in series. Phase control is effected by three circuits similar to that of FIG. 2.

When it is not necessary to disconnect galvanically the output voltage and the supply voltage, the consumption of active materials and labor consumption in the course of manufacturing the transformer 1 with magnetic commutation (FIG. 14) may be reduced by resorting to autotransformer circuitry.

In this case, the portion 164 of the secondary winding turns located in the window formed by the middle yoke 161 (FIG. 11) and the upper yoke 162 is connected to the taps of the portion 163 (FIG. 14) of the secondary winding arranged in the lower window formed by the lower yoke 160 (FIG. 11), the middle yoke 162 and some of the magnetic circuit legs 159, the connection being effected with the aid of contacts 169, 170 and 171 of magnetic starters. Magnetic starter contacts 172 and resistors 173 are intended to avoid disruptions in the working current while switching over from one continuous regulation range to another.

When the transformer 1 (FIG. 15) with autotransformer circuitry is intended for a limited regulation or only for voltage stabilization, the portion 164 of the secondary winding turns is always connected to certain points n of the portion 163 of the secondary winding turns of the lower window. The switch 27 of the power winding taps is built of thyristors 174, 175, 176, 177, 178 and 179. The thyristors 174 through 176 and 177 through 179 are serially interconnected into triangles, the power winding leads being connected to each of the vertices 180, 181, 182, 183, 184 and 185 of said triangles. The arrows show the path of a signal applied from the electronic commutator 15 (FIG. 1) to the switch 27 (FIG. 15) of the power winding taps. $U_1$ and $U_2$ of FIGS. 14 and 15 designate the supply voltage and the output voltage, respectively.

Continuous regulation and stabilization of voltage are done as follows. Output voltage of the transformer 1 is applied to the input 3 of the comparison unit 4. From the output 5 of the comparison unit 4 to the input 6 of the intermedite amplifier 7 there is applied an error signal whose magnitude and polarity correspond to the difference between the output voltage and a prescribed voltage magnitude. The intermediate amplifier 7 amplifies the error signal and sends it to the input 9 of the differential power amplifier 10. The differential power amplifier 10 increases current in one of the control windings 13 and 14 and reduces current in the other so as to eliminate the difference. Simultaneously, from the outputs 11 and 12 of the differential amplifier 10 there is applied a signal to the inputs 19 and 23 of the units 18 and 22 for measuring the voltage regulation margin. If the voltage regulation margin is exhausted, i.e. if it is no longer possible to increase or reduce voltage in the given range, from the unit 18 (22) for measuring the voltage regulation margin there is applied a signal to the electronic commutator 15. The commutator 15 sends an instruction to the switch 27 of the power windings' taps of the transformer 1. The switch 27 appropritely switches over the power windings of the transformer 1 so as to enable the voltage regulation and stabilization device to ensure the prescribed voltage magnitude.

The trigger 28 is to guarantee that, when switching on the transformer 1, the prescribed voltage should be reached from a minimum value, not from any value, to say nothing of the maximum.

The output voltage of the transformer 1 (FIG. 2) is rectified by of bridge rectifier 31 built around the diodes 32 through 37 and is applied to one of the diagonals 40–42' of the parametric bridge 41. From the other diagonal 5–52 of the parametric bridge 41 there is picked up an error signal of the prescribed voltage, the magnitude and polarity of this signal being determined by the deviation of the out put voltage from the prescribed value. Said signal is applied to the intermediate amplifier 7. The function of the intermediate amplifier 7 is performed by a contactless relay. The relay characteristic of the intermediate amplifier 7 is accounted for by the positive feedback from the collector of the transistor 54 via the resistor 53 to the base of the transistors 48. The resistor 49 and diodes 50 and 51 are intended to protect the transistor 48 from overvoltages during transient conditions. The transistor 60 is meant to invert the signal of the transistor 54. From the collectors of the transistors 54 and 60 of the intermediate amplifier 7, there is picked up a signal which is then applied to the input 9 of the differential power amplifier 10.

Depending upon the polarity of the signal applied to its input 9, the differential power amplifier 10 either connects or disconnects, through the transistors 63 and 66, the control windings 14 and 13 of the middle yoke 161 and the upper yoke 162 (FIG. 4), respectively, of the transformer 1.

If the voltage is below the prescribed magnitude, a positive signal is applied to the input 6 (FIG. 2) of the intermediate amplifier 7. The transistor 48 is non-conducting, the transistor 54 is driven into conduction, and the transitor 64 is non-conducting. In this case a positive signal is applied to the base of the transistor 63, and a negative signal to the base of the transistor 66. Due to the fact that the intermediate amplifier functions as a relay, the transistors 63 and 66 operate as switches.

With the above polarity of the input signal applied to the differential power amplifier 10, the transistors 63 is non-conducting, whereas the transistor 66 is driven into conduction. The current in the control winding 13 of the middle yoke 161 increases, whereas it decreases in the control winding 14 of the upper yoke 162. The resistance to the magnetic flux of the middle yoke 161 correspondingly increases, while that of the upper yoke 162 decreases. There is an increase in that part of the alternating flux which flows through the upper yoke 162 and envelops the portion 164 of the secondary winding turns arranged in the upper window. The flux linkage and, consequently, the electromotive force of the portion 164 of the secondary winding turns located in the upper window start to increase. The output voltage of the transformer 1 increases until it is in excess of the prescribed magnitude. In this case, a negative signal is applied to the input 6 of the intermediate amplifier 7. The transistor 48 is driven into conduction, the transistor 54 is rendered non-conducting, and the transistor 60 is snapped into conduction. A positive signal is applied to the base of the transistor 66, and a negative signal is applied to the base of the transistor 63. The transistor 66 is rendered non-conducting. The current in the control winding 14 of the upper yoke 162 starts to increase, while it decreases in the control winding 13 of the middle yoke 161. The resistance to the magnetic flux of the middle yoke 161 is reduced, whereas that of the upper yoke 162 is raised.

The part of the magnetic flux, which has hitherto flown through the upper yoke 162, is reduced; as a result, the flux linkage and, consequently, the electromotive force in the part 164 of the secondary winding turns arranged in the upper window are reduced, so the output voltage of the transformer 1 is reduced until it is below the prescribed value. This again reverses the polarity of the signal arriving from the parametric bridge 141, etc.

Thus, by alternately bringing into play the control windings 13 and 14, depending upon the deviation of the output voltage from the prescribed magnitude, one stabilizes voltage by the transformer 1. Output voltage is set by varying the resistance of the resistor 39.

The diodes 67 and 71 are to continuously maintain current in the control windings 14 and 13 of the yokes 161 and 162, respectively, of the transformer 1, to well as protect the transistors 63 and 66 from overvoltages during switchings. The resistors 68 and 72 are to eliminate high-frequency harmonic components.

Consider now operation of the unit 18 (FIG. 3) for measuring the voltage regulation margin. The transistor 73 inverts the signal arriving from the differential power amplifier 10. When the transistor 73 is non-conducting, the capacitor 78 is charged through the resistors 75 and 76. When the transistor 73 is driven into conduction, the capacitor 78 discharges through the emitter-collector junction of the transistor 73 and the resistor 76. The charge time constant of the capacitor 78 is much greater than the discharge time constant, because the resistance of the resistor 75 is several orders greater than the sum total of the resistances of the resistor 76 and the emitter-collector junction of the conducting transistor 73.

The resistances of the resistors 75 and 76 are selected so that the voltage magnitude to which the capacitor 78 is charged is not in excess of the stabilization voltage of the avalanche diode 79 in the course of continuous regulation and stabilization of voltage.

When the transistor 73 is conducting, the capacitor 78 fully discharges. As a result, there is no charge storage in the capacitor 78, no current flows through the avalanche diode, and the transistor 81 is rendered non-conducting. When the voltage regulation margin is exhausted, the capacitor 78 is charged to a reach voltage whose magnitude is in excess of the breakdown voltage of the avalanche diode 79; the transistor 81 is driven into conduction and sends a signal to the electronic commutator 15. The electronic commutator 15 has several steady states whose number is equal to that of the ranges of continuous regulation of voltage of the transformer 1. The electronic commutator 15 is built of the flip-flops 84 and 105.

The outputs 96, 99, 114, 116 of the flip-flops 84 and 105 are connected to the logical NAND circuits 98, 102 and 104 which send an instruction to the switch 27 of the power windings' taps. Simultaneously, from the output 120 of the logical NAND circuit 98 there is applied a signal to the input 122 of the delay unit 123. The delay unit 123 is meant to avoid the switching over from the first range to the third, bypassing the second. The switching to any range is avoided with the aid of the trigger 28. As the device for continuous voltage regulation and stabilization is switched on, the capacitor 138 is charged through the resistor 135 and the emitter-base junction of the transistor 134. As the capacitor 138 is being charged, the transistor 134 is conducting. From the collector of the transistor 134, zero potential is applied via th diodes 143 ad 144 to the input 89 of the flip-flop 84 and the input 106 of the second flip-flop 105. The flip-flops 84 and 105 assume states which correspond to the negative signals at the inputs 97 and 119 of the logical NAND circuit 98. The logical NOT AND circuit 98 initiates a signal which is sent to the switch 27 of the power windings' taps of the transformer 1. The taps of the power windings of the transformer 1 may be switched by magnetic starters, thyristors or any other commutation devices. In the present case, those power windings' taps are brought into play, which correspond to the minimum output voltage. If the regulation margin is exhausted in the given range, a zero signal is applied from the unit 18 for measuring the voltage regulation margin to the input 85 of the flip-flop 84. The state of the flip-flop 84 is reversed, so that both negative signals are at the inputs 101 and 118 of the logical NAND circuit 102. At the same time, across at least one input of the logical NAND circuits 98 and 104 there is a positive signal. The logical NAND circuit 102 sends a signal to the switch 27 of the power windings' taps for bringing into play other power windings of the transformer 1.

Simultaneously, from the output 17 of the unit 18 for measuring the voltage regulation margin there is applied a signal to the input 87 of the logical Nor circuit 88. That notwithstanding, the state of the logical NOR remains unchanged, because it is maintained by the signal from the inverter 125. The inverter's state is changed, when the state of the flip-flop 84 is changed, by a signal arriving from the logical NOT AND circuit 98, said signal arriving with a time lag whose duration is greater than the time of switching the power windings' taps of the transformer 1.

If the prescribed voltage is within the second range, there starts the process of continuous voltage regulation and stabilization, and the signal, which carries information on exhausting the voltage regulation margin, is picked up from the input 87 of the logical circuit 88. If the prescribed voltage is still in excess of the magnitude that can be reached in the second range, a zero potential remains at the input 87 of the logical NOR circuit 88. After some time, its duration being determined by the delay unit 123, a zero potential is applied to the second input 126 of the logical NOR circuit 88 from the inverter 125. The state of the logical NOR circuit 88 is reversed, and it applies zero potential via the inverter 111 to the input 108' of the second flip-flop 105. The state of the second flip-flop is reversed, and so is the state of the logical NAND circuits 102 and 104. At this instant, there are negative signals at both inputs 103 and 115 of the logical NAND circuit 104. An instruction is sent to the switch 27 of the power windings' taps of the transformer 1 to bring into play the third range of continuous voltage regulation.

The switching over from the third continuous voltage regulation range to the second, and from the second to the first is similar to what is described above, but the signal, which carries information on the extent to which the regulation margin is exhausted, is applied to the electronic commutator 15 from the unit 22 for measuring the voltage regulation margin.

Figure 3:
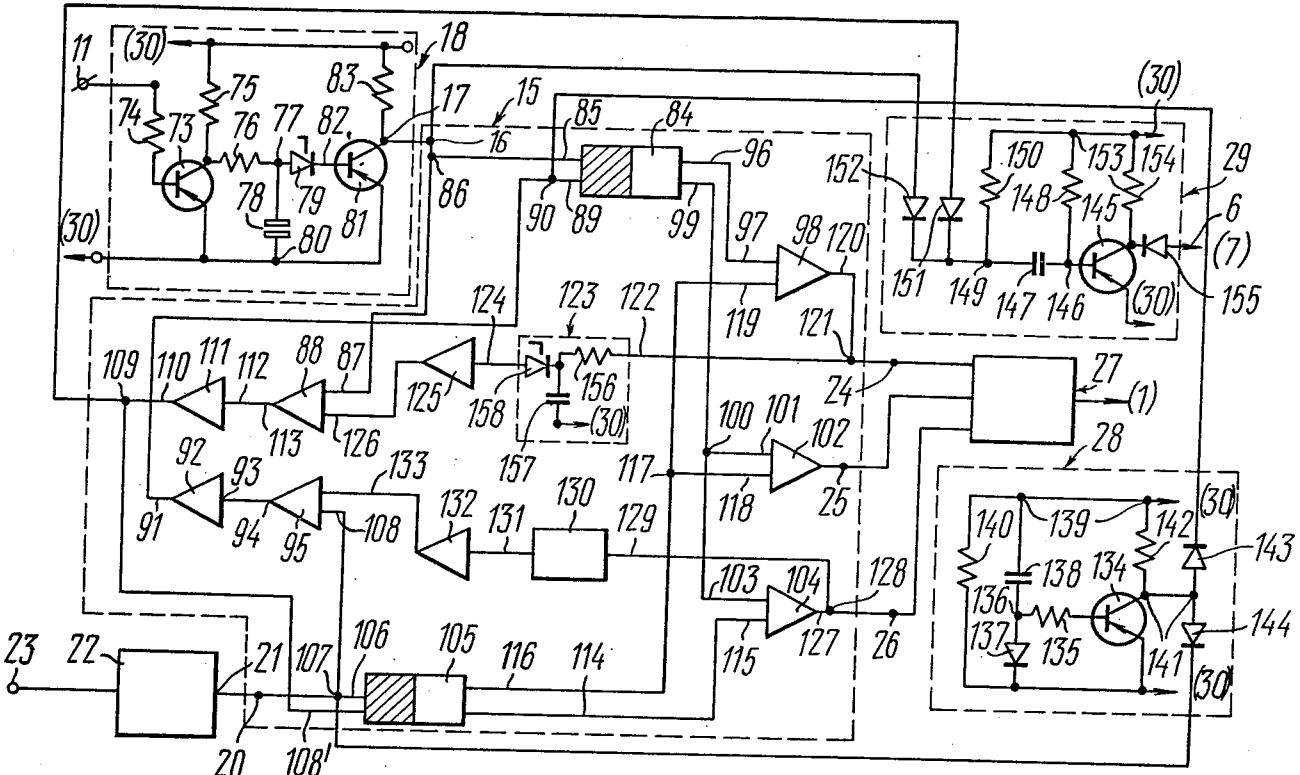
FIG. 3 is an electrical schematic diagram of a device for switching the taps of power windings of a transformer whose yokes are controlled on the basis of the voltage control margin, in accordance with the invention.

The switching over to a higher voltage range is accompanied by a short-lived voltage peak whose magnitude is equal to the regulation value of said continuous voltage regulation range. This is due to the fact that at the moment of switching the taps of the power windings of the transformer 1, the middle yoke 161 (FIG. 4) of the transformer 1 is magnetized, which corresponds to the maximum voltage in the given range. In order to eliminate said voltage peak, a negative signal is applied to the input 6 (FIG. 1) of the intermediate amplifier 7 from the collector of the transistor 145 (FIG. 3).

As the negative signal arrives at the intermediate amplifier 7 (FIG. 2), the control winding 13 of the middle yoke 161 (FIG. 4) of the transformer 1 is disconnected, whereby the output voltage is reduced. The transistor 145 (FIG. 3) is rendered non-conducting, as to its base there is applied, via the capacitor 147 and diodes 151 and 152, a positive signal from the output 17 of the unit 18 for measuring the voltage regulation margin and from the output 113 of the logical NOR circuit 88, which takes place at a moment when the voltage regulation margin has been exhausted and it is necessary to switch over to a higher voltage range.

The unit 22 for measuring the voltage regulation range operates in a manner identical with that of the unit 18.

Thus, the combination of continuous voltage regulation within a limited range with automatic switching from one continuous voltage regulation range to another is a characteristic feature of the proposed continuous voltage regulation device which is marked by a high energy factor and low consumption of active materials.

Figure 6:
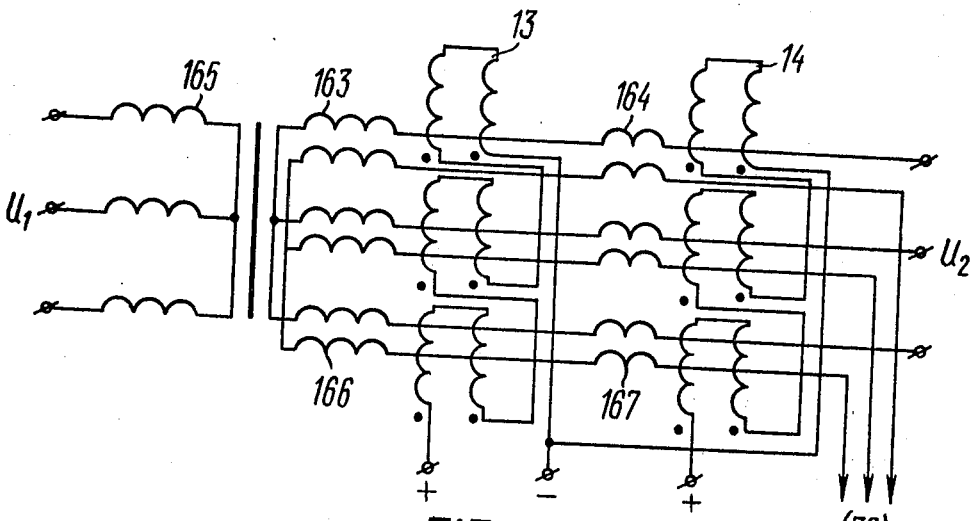
FIG. 6 is an electrical schematic diagram of a three-phase symmetrical, magnetic commutation-controlled transformer whose yokes form a closed polygon, in accordance with the invention.

In the proposed voltage regulation and stabilization device, the transformer 1 (FIG. 4), which is controlled by magnetizing its yokes, may be single-phase or three-phase. The three-phase symmetrical transformer 1 is preferable in order to avoid phase asymmetry of voltage. In this type of transformer 1, the magnetic circuit legs 159 are arranged at an angle of 120° to each other, the yokes 160, 161 and 162 being arranged between said magnetic circuit legs 159. In this transformer 1 (FIGS. 4 and 5), the controlled middle and upper yokes 161 and 162 form a closed polygon which is split into two portions. On each of said portions of the yokes 161 and 162 there are arranged the coils of the control windings 13 and 14 (FIG. 6). Said coils are interconnected so that the magnetic fields produced by direct current in the split portions of the controlled yokes 161 and 162 are oriented in opposition. This provides for mutual compensation of even harmonics which are the result of direct current magnetization of the yokes 161 and 162. This also compensates for the basic frequency electromotive force in the control windings 13 and 14. The foregoing embodiment of the three-phase symmetrical transformer 1 (FIGS. 4 and 5), which is controlled through magnetization of its yokes 161 and 162, makes it possible to reduce the nonlinear distortion factor of the proposed voltage regulation and stabilization device to a value below 5 percent.

Figure 10:
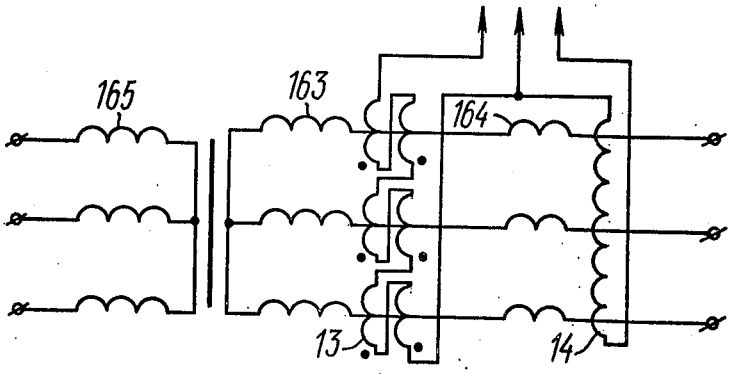
FIG. 10 is an electrical schematic diagram of a three-phase symmetrical transformer with magnetic commutation, whose yokes make up a star connection.

The proposed voltage regulation and stabilization device may employ a three-phase symmetrical transformer 1 (FIGS. 7, 8 and 9) whose yokes 161 and 162 are connected in a star. The control power of the upper yoke 162 of the transformer 1, which is required to counteract the idle-state flux, is considerably less than the control power of the middle yoke 161, so the upper yoke 162 is provided with one control winding 14 arranged along the symmetry axis of the transformer 1. Said control winding 14 magnetizes the upper yoke 162 which forms a star. The control winding 13 of the middle yoke 161 is composed of individual coils which are arranged on the half-yokes of each prong of the star (FIGS. 7 and 9) and interconnected in series (FIG. 10). Such an embodiment of the transformer 1 (FIG. 7) ensures a desired continuous voltage regulation range with a low nonlinear distortion factor (which is not in excess of 5 percent). However, this transformer 1 does not provide for phase-by-phase voltage regulation. To achieve this goal, the proposed voltage regulation and stabilization device employs a three-phase symmetrical transformer 1 (FIGS. 11 and 12) controlled by magnetizing the yokes 161 and 162 which form a star. This type of transformer 1 differs from that of FIGS. 7, 8 and 9 in that it has central leg (FIG. 12), whereas the control windings 13 and 14 (FIG. 13) are composed of three pairs of coils 13', 13'', 13''', 14', 14'', 14''' mounted on the half-yokes. The coil pairs 13' and 14', 13'' and 14'', and 13''' and 14''' of the control windings 13 and 14 of each phase A, B and C are places in series and connected to individual control circuits. Each of said control circuits is similar to that of FIG. 2. In case of a change in the current of a pair of coils, for example, 13' and 14', there is regulated the voltage of the corresponding phase. The central leg 168 (FIG. 12) serves to reduce the effect of one phase upon the others in cases of load or supply current asymmetries.

When it is not necessary to galvanically separate the output voltage and the supply voltage, it is possible to reduce the consumption of active materials and labor consumption, while manufacturing the transformer 1, by resorting to autotransformer circuitry (FIG. 14). The autotransformer circuitry of FIG. 14 ensures high, continuous regulation of output voltage practically down to zero. The voltage regulation is conducted in three steps, without interrupting the working current. The continuity of the working current, while switching over from one tap to another of the portion 163 of the secondary winding turns of the lower window, is ensured with the aid of the contacts 172 of the magnetic starter and the resistors 173.

In order to achieve a lower regulation value or stabilization alone of voltage, the portion 164 (FIG. 15) of the secondary winding turns of the upper window is permanently connected to a certain point *n* of the part 163 of the secondary winding turns of the lower window. The switch 27 of the power windings' taps, which is built of the thyristors 174 through 179, changes the number of turns by connecting in a star the portion 163 of the secondary winding turns of the lower window. Signals are sent to the control electrodes of the thyristors 174 through 176 and 177 through 179 by the electronic commutator 15 (FIG. 3). When the thyristors 174 through 176 are in the state of conduction, the vertices 180, 181 and 182 are connected in a star. The voltage per turn increases, and so does the output voltage $U_2$. Normally, the thyristors 174 through 176 are driven into conduction when the middle yoke 161 (FIG. 12) is magnetized and the supply voltage $U_1$ is lowered. When the thyristors 174 through 176 are conducting, the portion 163' of the secondary winding turns of the lower window is out of operation. When the thyristors 177 through 179 are in the state of conduction, the vertices 183, 184 and 185 are connected in a star. The supply voltage $U_1$ is applied to all the winding turns of the lower window. The voltage per turn is reduced, and so is the total output voltage $U_2$. A signal from the electronic commutator 15 (FIG. 3) is normally applied to the thyristors 177 through 179 to drive them into conduction when the upper yoke 162 (FIG. 12) is magnetized and the supply voltage $U_1$ is elevated. The switches 27 of the power windings' taps may be built of magnetic starters, thyristors or any other types of commutation devices.

What is claimed is:

1. A voltage regulation and stabilization device comprising:

(a) a transformer with power windings on its magnetic circuit legs, said power windings having taps, yokes of said transformer being arranged between said magnetic circuit legs, some of said yokes having control windings for direct current magnetization of said yokes, a portion of said power windings' turns being arranged in a window formed by the yokes, whereupon there are mounted said control windings;

(b) a switch connected to the power windings' taps of said transformer; and (c) at least one control circuit comprising: a comparison unit having an input and an output, said input being connected to said transformer; an intermediate amplifier having an input and a reversible output, said input of said intermediate amplifier being connected to said output of said comparison unit; a differential power amplifier having an input and output, said input being connected to said reversible output of said intermediate amplifier, each of said outputs being connected to one of said control windings of said transformer's yokes; a plurality of units for measuring the voltage regulation margin, each having an input and an output, said input of each of said units for measuring the voltage regulation margin being connected to one of said outputs of said differential amplifier; an electronic commutator comprising flip-flops logical NOR circuits and logical NAND circuits, inverters and delay units and having inputs and outputs, said inputs being connected to respective outputs of said units for measuring the voltage regulation margin, said outputs of said electronic commutator being connected to said switch connected to the power windings' taps of said transformer; and a power source for the control circuit's units to which there is connected said comparison unit, said intermediate amplifier, said differential power amplifier, said electronic commutator and said units for measuring the voltage regulation margin.

2. A device as claimed in claim 1, further comprising a trigger connected to said electronic commutator and comprising a transistor and a capacitor in its charge and discharge circuits.

3. A device as claimed in claim 2, further comprising an inverter having an input and an output, said input being connected via a capacitor to one of said inputs of said electronic commutator, said output of said inverter being connected via a diode to said input of said intermediate amplifier.

4. A device as claimed in claim 2, wherein said transformer is a three-phase symmetrical transformer, said magnetic circuit legs being arranged at an angle of 120° to each other, said yokes being arranged between said magnetic circuit legs, two of said yokes being controlled, and one being uncontrolled.

5. A device as claimed in claim 2, wherein said transformer is provided with supply windings of the control circuit's units, said supply windings being mounted directly on said magnetic circuit legs of said transformer.

6. A device as claimed in claim 2, wherein said transformer's circuitry is that of an autotransformer.

7. A device as claimed in claim 1, further comprising an inverter having an input and an output, said input being connected via a capacitor to one of said inputs of said electronic commutator, said output of said inverter being connected via a diode to said input of said intermediate amplifier.

8. A device as claimed in claim 7, wherein said transformer is a three-phase symmetrical transformer, said magnetic circuit legs of said transformer being arranged at an angle of 120° to each other, said yokes being arranged between said magnetic circuit legs, two of said yokes being controlled, and one being uncontrolled.

9. A device as claimed in claim 7, wherein said transformer is provided with supply windings of the control circuit's units, said supply windings being mounted directly on the magnetic circuit legs of said transformer.

10. A device as claimed in claim 7, wherein said transformer's circuitry is that of an autotransformer.

11. A device as claimed in claim 1, wherein said transformer is a three-phase symmetrical transformer, said magnetic circuit legs of said transformer being arranged at an angle of 120° to each other, said yokes being arranged between said magnetic circuit legs, two of said yokes being controlled, and one being uncontrolled.

12. A device as claimed in claim 11, wherein said yokes of said transformer are constructed in the form of a star.

13. A device as claimed in claim 12, wherein said control winding of one of said controlled yokes is arranged along a symmetry axis of said three-phase symmetrical transformer, said control winding of the other controlled yoke being composed of individual coils mounted on half-yokes and interconnected in series opposition.

14. A device as claimed in claim 12, wherein said three-phase symmetrical transformer has a central leg, each said control winding of said controlled yokes being composed of three pairs of coils mounted on half-yokes, each two of said pairs of coils of one phase of said control windings being placed in series opposition and connected to one of said control circuits.

15. A device as claimed in claim 11, wherein said transformer is provided with supply windings of the control circuit's units, said supply windings being mounted directly on said magnetic circuit legs of said transformer.

16. A device as claimed in claim 11, wherein said transformer's circuitry is that of an autotransformer.

17. A device as claimed in claim 11, wherein said control winding of one of said controlled yokes is arranged along a symmetry axis of said three-phase symmetrical transformer, said control winding of the other of said controlled yokes being composed of individual coils mounted on half-yokes and interconnected in series opposition.

18. A device as claimed in claim 17, wherein said three-phase symmetrical transformer has a central leg, each of said control windings of said controlled yokes being composed of three pairs of coils mounted on the half-yokes, each two of said pairs of coils of one phase of said control windings being placed in series opposition and connected to one of said control circuits.

19. A device as claimed in claim 17, wherein said transformer is provided with supply windings of the control circuit's units, said supply windings being mounted directly on said magnetic circuit legs of said transformer.

20. A device as claimed in claim 17, wherein said transformer's circuitry is that of an autotransformer.

21. A device as claimed in claim 11, wherein said three-phase symmetrical transformer has a central leg, each of said control windings of said controlled yokes being composed of three pairs of coils mounted on half-yokes, each two of said pairs of coils of one phase of said control windings being interconnected in series opposition and connected to one of said control circuits.

22. A device as claimed in claim 21, wherein said transformer is provided with supply windings of the control circuit's units, said supply windings being mounted directly on said magnetic circuit legs of said transformer.

23. A device as claimed in claim 16, wherein said transformer's circuitry is that of an autotransformer.

24. A device as claimed in claim 11, wherein said controlled yokes of said three-phase symmetrical transformer form a closed polygon and are split into two portions, on each of said two portions there being mounted the coils of said control windings of said controlled yokes, which coils are placed in series opposition.

25. A device as claimed in claim 24, wherein said transformer is provided with supply windings of the control circuit's units, said supply windings being mounted directly on said magnetic circuit legs of said transformer.

26. A device as claimed in claim 25, wherein said transformer's circuitry is that of an autotransformer.

27. A device as claimed in claim 24, wherein said transformer's circuitry is that of an autotransformer.

28. A device as claimed in claim 11, wherein said transformer is provided with supply windings of the control circuit's units, said supply windings being mounted directly on said magnetic circuit legs of said transformer.

29. A device as claimed in claim 11, wherein said transformer's circuitry is that of an autotransformer.

30. A device as claimed in claim 1, wherein said transformer is provided with supply windings of the control circuit's units, said supply windings being mounted directly on said magnetic circuit legs of said transformer.

31. A device as claimed in claim 30, wherein a portion of the turns of said supply windings of the control circuit's units is arranged in the window formed by said controlled yokes.

32. A device as claim in claim 30, wherein said transformer's circuitry is that of an autotransformer.

33. A device as claimed in claim 1, wherein said transformer's circuitry is that of an autotransformer.

* * * * *